US008248323B2

(12) United States Patent
Grossman et al.

(10) Patent No.: US 8,248,323 B2
(45) Date of Patent: Aug. 21, 2012

(54) ANTENNA AND METHOD OF FORMING SAME

(75) Inventors: Ovadia Grossman, Tel Aviv (IL); Moshe Ben Ayun, Shoham (IL); Maksim Berezin, Natanya (IL); Sooliam Ooi, Plantation, FL (US); Mark Rozental, Gedera (IL)

(73) Assignee: Motorola Solutions, Inc., Schaumburg, IL (US)

( * ) Notice: Subject to any disclaimer, the term of this patent is extended or adjusted under 35 U.S.C. 154(b) by 879 days.

(21) Appl. No.: 12/129,739

(22) Filed: May 30, 2008

(65) Prior Publication Data

US 2009/0295672 A1 Dec. 3, 2009

(51) Int. Cl.
*H01Q 1/36* (2006.01)
*H01Q 13/00* (2006.01)

(52) U.S. Cl. ..... 343/895; 343/700 MS; 29/600

(58) Field of Classification Search ..... 343/895, 343/700 MS, 702
See application file for complete search history.

(56) References Cited

U.S. PATENT DOCUMENTS

| | | | | |
|---|---|---|---|---|
| 3,956,750 | A * | 5/1976 | Jones | 343/712 |
| 4,270,128 | A * | 5/1981 | Drewett | 343/702 |
| 5,668,559 | A * | 9/1997 | Baro | 343/702 |
| 5,977,931 | A * | 11/1999 | Openlander | 343/895 |
| 6,140,973 | A * | 10/2000 | Annamaa et al. | 343/790 |
| 6,340,954 | B1 * | 1/2002 | Annamaa et al. | 343/895 |
| 6,421,029 | B1 | 7/2002 | Tanabe | |
| 6,486,852 | B1 * | 11/2002 | Hirose et al. | 343/895 |
| 6,525,692 | B2 * | 2/2003 | Kim et al. | 343/702 |
| 6,710,752 | B2 * | 3/2004 | Saito et al. | 343/895 |
| 7,701,404 | B2 * | 4/2010 | McKivergan | 343/742 |
| 2004/0108967 | A1 | 6/2004 | Fujimura et al. | |
| 2006/0290590 | A1 * | 12/2006 | Takaoka et al. | 343/895 |
| 2007/0222700 | A1 * | 9/2007 | De Flaviis et al. | 343/895 |
| 2008/0316138 | A1 * | 12/2008 | Tavassoli Hozouri | 343/859 |

FOREIGN PATENT DOCUMENTS

| | | | |
|---|---|---|---|
| EP | 0666613 | A1 | 8/1995 |
| JP | 0153531 | A | 2/2001 |
| WO | 9844590 | A1 | 10/1998 |
| WO | 2005024998 | A1 | 3/2005 |

OTHER PUBLICATIONS

Zhi Ning Chen—"Novel Bi-Arm Rolled Monopole for UWB Applications"—IEEE Transaction on Antennas and Propagation, vol. 53, No. 2, Feb. 2005—pp. 672-677.

Grandi, G. et al., "Stray Capacitances of Single-Layer Solenoid Air-Core Inductors," IEEE Transactions on Industry Applications, vol. 35, No. 5, pp. 1162-1168, Sep./Oct. 1999.

International Search Report and Written Opinion for International Application No. PCT/US2009/045360 mailed on Dec. 29, 2009.

International Preliminary Report on Patentability and Written Opinion for International Application No. PCT/US2009/045360 issued on Nov. 30, 2010.

* cited by examiner

*Primary Examiner* — Dieu H Duong
(74) *Attorney, Agent, or Firm* — Barbara R. Doutre

(57) ABSTRACT

An antenna and methods for manufacturing the antenna is provided. The antenna (100) includes an electrically non-conductive substrate (102). The antenna further includes an electrically conductive strip (104). The electrically conductive strip (104) is wound around the electrically non-conductive substrate (102) so as to form an overlap (120) between adjacent turns of the electrically conductive strip (104), without creating a galvanic connection at the overlap.

27 Claims, 7 Drawing Sheets

ANTENNA AND METHOD OF FORMING SAME

FIELD OF THE INVENTION

The invention generally relates to antennas. More specifically, the invention relates to an antenna and methods of designing and forming the antenna.

BACKGROUND OF THE INVENTION

In wireless communication systems that utilize Very High Frequency (VHF) and Ultra High Frequency (UHF), whip antennas are used. The frequency range of a whip antenna is a function of the capacitance and the inductance of the whip antenna. Additionally, the accuracy of the frequency response is dependent on the number of resonant elements in the antenna, i.e., Inductor L and Capacitance C (LC) pairs. Further, the capacitance and the inductance of a whip antenna depend on the shape and size of the whip antenna.

A whip antenna is typically fabricated by using a helix injection molding technique. Using this technique, the whip antenna is wound helically into a predetermined helical shape and size to form a mold. Thereafter, the antenna material is injected into the mold to form a helical shape. The number of helixes and the gap between helixes in a whip antenna determines capacitance of the whip antenna and the number of LC pairs. Whip antennas fabricated using helix injection molding techniques are limited to supporting narrow ranges of frequencies due to practical limitations in the shape and size of the whip antennas. The limitations in shape and size may result to inaccuracy in frequency response at higher frequencies In order to support multiband and wideband coverage, whip antenna designers are faced with the challenges of complexity of design to achieve a desired frequency range and maintaining accuracy levels of the frequency response. Overcoming the limitations in a whip antenna fabricated using helix injection molding is technically difficult and expensive due to the shape and dimensions required for practical use, such as for example a two-way radio.

Therefore, whip antennas designed by using existing design methods have a limited frequency range and issues with maintaining an accurate frequency response. A need thus exists for an improved antenna and a method of forming the same.

BRIEF DESCRIPTION OF THE FIGURES

The accompanying figures where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1A:
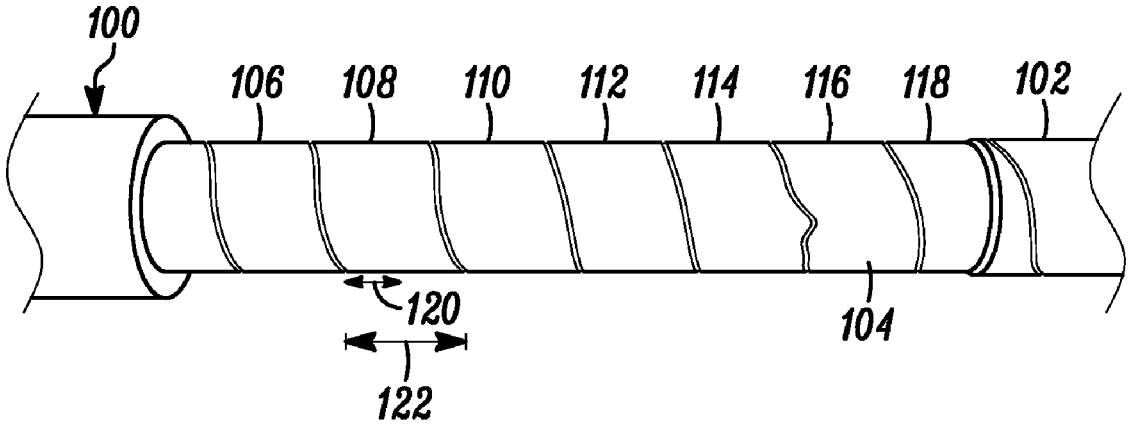
FIGS. 1A, 1B and 1C show an antenna formed in accordance with an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Before describing in detail embodiments that are in accordance with the present invention, it should be observed that the embodiments reside primarily in combinations of method steps and apparatus components related to an antenna and method for designing and forming the antenna. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

In the description herein, numerous specific examples are given to provide a thorough understanding of various embodiments of the invention. The examples are included for illustrative purpose only and are not intended to be exhaustive or to limit the invention in any way. It should be noted that various equivalent modifications are possible within the spirit and scope of the present invention. One skilled in the relevant art will recognize, however, that an embodiment of the invention can be practiced with or without the apparatuses, systems, assemblies, methods, components mentioned in the description.

Pursuant to various embodiments, the present invention provides an antenna and a method for manufacturing the antenna. The antenna, for example, may be a whip antenna. The antenna includes an electrically non-conductive substrate and an electrically conductive strip. The electrically conductive strip is wound around the electrically non-conductive substrate so as to form an overlap between adjacent turns of the electrically conductive strip. There is no galvanic connection at the overlap between adjacent turns.

FIG. 1 shows an antenna 100, in accordance with an embodiment of the invention. The antenna 100 may be a whip antenna. In an embodiment of the invention, the antenna 100 is used for Very High Frequency (VHF) and Ultra High Frequency (UHF). The antenna 100 may be a part of one or more of, but is not limited to an automobile radio receiver, a portable Radio Frequency (RF) receiver, a laptop computer with communication capabilities, a two-way radio, a Personal Digital Assistant (PDA) with communication capabilities, a messaging device, and a mobile telephone.

The antenna 100 includes an electrically non-conductive substrate 102. The electrically non-conductive substrate 102 may be one of, but is not limited to a rubber rod, a plastic rod, a polycarbonate rod, and an elastomer rod. The electrically non-conductive substrate 102 may be formed from a plurality of heterogeneous substrates. For example, the electrically non-conductive substrate 102 may be made up of rubber and plastic. The electrically non-conductive substrate 102 is cylindrical in shape. Alternatively, the electrically non-conductive substrate 102 may have one or more of but not limited a helical shape, a circular shape, a triangular shape, and a rectangular shape.

The antenna 100 further includes an electrically conductive strip 104. It will be apparent to a person skilled in the art that the antenna 100 may include more than one electrically conductive strip. The electrically conductive strip 104 may be one of, but is not limited to, a copper strip, a brass strip, an aluminum strip, and a stainless steel strip. The electrically conductive strip 104 may include a plurality of electrically conductive strips connected in series. Each of the plurality of electrically conductive strips may be of a different material.

The electrically conductive strip 104 is wound around the electrically non-conductive substrate 102, such that, the electrically conductive strip 104 forms a plurality of turns (for example, a turn 106, a turn 108, a turn 110, a turn 112, a turn 114, a turn 116, and a turn 118) around the electrically non-conductive substrate 102. It will be apparent to a person skilled in the art that the antenna 100 is not limited to the number of turns of the electrically conductive strip 104 as shown in FIG. 1. In an embodiment, if the antenna 100 includes more than one electrically conductive strip, each electrically conductive strip may be separately wound around the electrically non-conductive substrate 102. Each electrically conductive strip may be of a different material. For example, the antenna 100 may include a copper strip, an aluminum strip, and a brass strip. In this case, the copper strip, the aluminum strip, and the brass strip may be separately wound around the electrically non-conductive substrate 102.

A width of the electrically conductive strip 104 may vary along the length of the electrically non-conductive substrate 102. The variation in the width changes the frequency response and the frequency range provided by the antenna 100. For example, an increase in the width may decrease the operational frequency range of the antenna 100, with a simultaneously increase in the frequency response bandwidth of the antenna 100.

The electrically conductive strip 104 is wound around the electrically non-conductive substrate 102 so as to form an overlap between adjacent turns (for example the turn 106 and the turn 108; the turn 108 and the turn 110; the turn 110 and 112; and the turn 112 and the turn 114) of the electrically conductive strip 104. There is no galvanic contact at the overlap between the adjacent turns. This is achieved by introducing a dielectric material between overlapping surfaces at the overlap between the adjacent turns. This is further explained in conjunction with FIG. 1B. For example, the turn 106 of the electrically conductive strip 104 adjacent to the turn 108 of the electrically conductive strip 104 forms an overlap 120. The overlap 120 does not create any galvanic connection between surfaces of the turn 106 and the turn 108. The overlap between adjacent turns is less than the width of the electrically conductive strip 104. For example, the overlap 120 between the turn 106 and the turn 108 is less than a width 122 of the electrically conductive strip 104 at turn 108. As a result of this, the overlap between the adjacent turns of the antenna 100 provides a resonant element, which corresponds to a capacitor and an inductor. Therefore, the overlap between adjacent turns of the electrically conductive strip 104 produces a frequency range and a frequency response equivalent to a resonant element.

The number of turns of the electrically conductive strip 104 around the electrically non-conductive substrate 102 represents an equal number of resonant elements. Accordingly, an increase in the number of turns of the electrically conductive strip 104 around the electrically non-conductive substrate 102 corresponds to an increase in the number of resonant elements. Based on this, the frequency response bandwidth of the antenna 100 may be modified by increasing the number of the turns of the electrically conductive strip 104 around the electrically non-conductive substrate 102.

In an embodiment of the invention, the overlap between adjacent turns of the electrically conductive strip 104 may vary along the length of the electrically conductive strip 104. A decrease in the overlap increases the operating frequency and the frequency range of the antenna 100. More specifically, as the overlap is decreased, the number of turns of the electrically conductive strip 104 around the electrically non-conductive substrate 102 increases, which further increases the lowest operating frequency of the antenna 100.

The predefined frequency range and the predefined frequency response of the antenna 100 depends on parameters, such as, the overlap between the adjacent turns, the width of the electrically conductive strip 104, the number of turns of the electrically conductive strip, the distance between overlapping surfaces in adjacent turns, and the dielectric between the overlapping surfaces. These parameters can be modified to achieve a desired frequency range and a desired frequency response. Thus the antenna 100 provides an enhanced performance over the prior antennas.

Those skilled in the art will appreciate that elements in the FIG. 1 are illustrated for simplicity and clarity and have not necessarily been drawn to scale. The shapes and the sizes of the elements of the antenna 100 described in FIG. 1 may be varied in a manner described herein in order to achieve a desired frequency response. The method for forming the antenna 100 is explained in conjunction with FIG. 2, FIG. 3, FIG. 4 and FIG. 5.

Figure 1B:
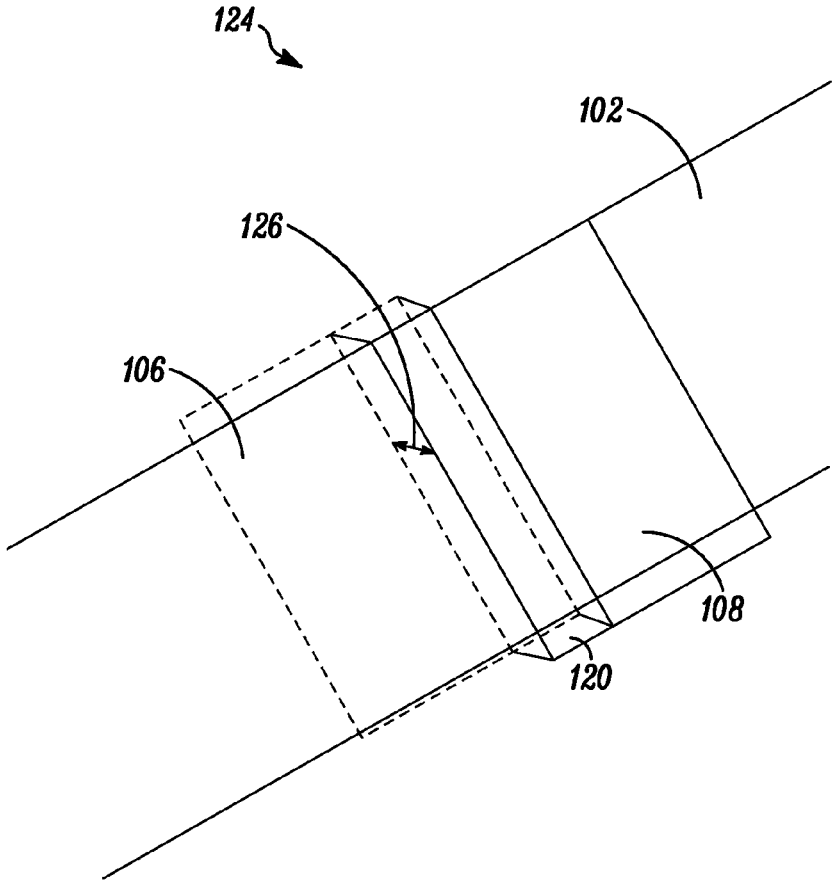
Figure 1C:
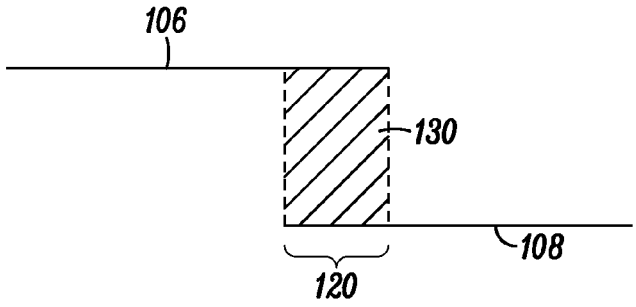

FIG. 1B shows a side view 124 of the antenna 100 formed in accordance with an embodiment of the invention. The side view 124 shows the overlap 120 between the turn 106 and the turn 108 of the electrically conductive strip 104. Overlapping surfaces at the overlap are separated by a distance 126. This separation is facilitated by a dielectric material (not shown in the FIG. 1B) filled in the overlap 120. The distance 126 may be decreased to increase the frequency range of the antenna 100. Alternatively, the distance 126 may be increased to decrease the frequency range of the antenna 100. FIG. 1C shows a more detailed view of the overlap 120 in the antenna 100 shown in FIG. 1B. The overlap 120 between the turn 106 and the turn 108 is filled with a dielectric material 130.

Figure 2:
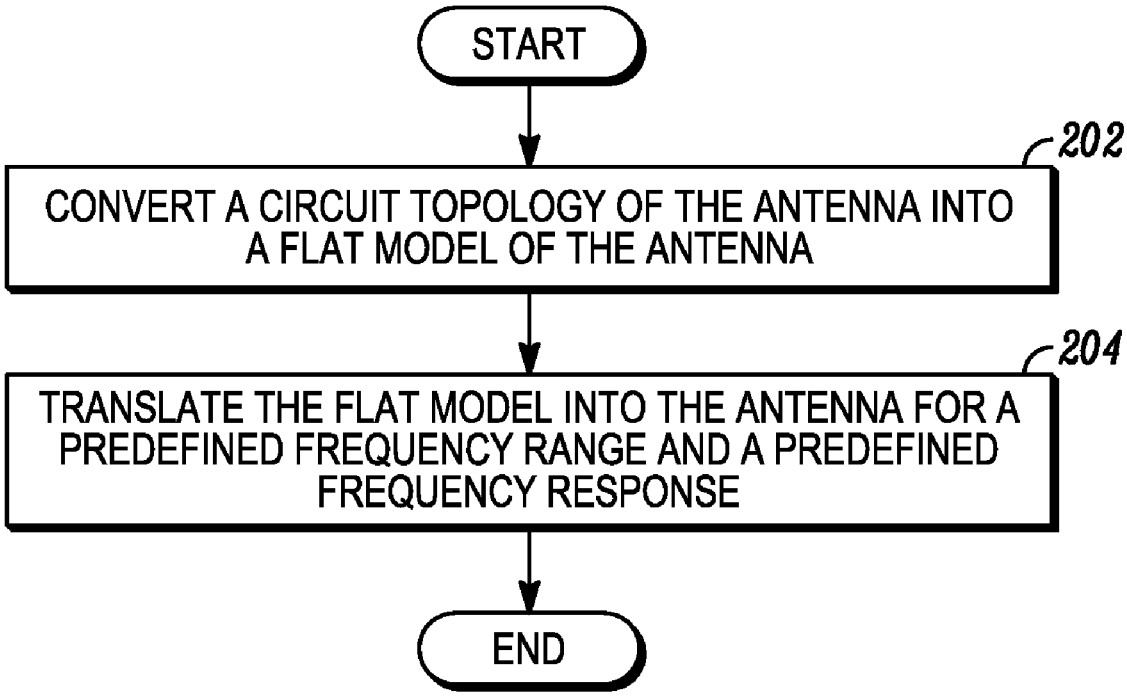
FIG. 2 is a flow chart of a method of forming an antenna, in accordance with an embodiment of the invention.

Briefly, as shown in the FIG. 2 a circuit topology of the antenna 100 is converted into a flat model representation of the antenna 100 at step 202. The flat model representation of the antenna 100 includes one or more conductive materials dispersed across a dielectric sheet. A conductive material may be one or more of, but is not limited to copper, brass, aluminum, and stainless steel. Thereafter, at step 204, the flat model representation of the antenna 100 is translated into the antenna 100 for the predefined frequency range and the predefined frequency response. These steps are further explained in detail in conjunction with FIG. 3.

Figure 3:
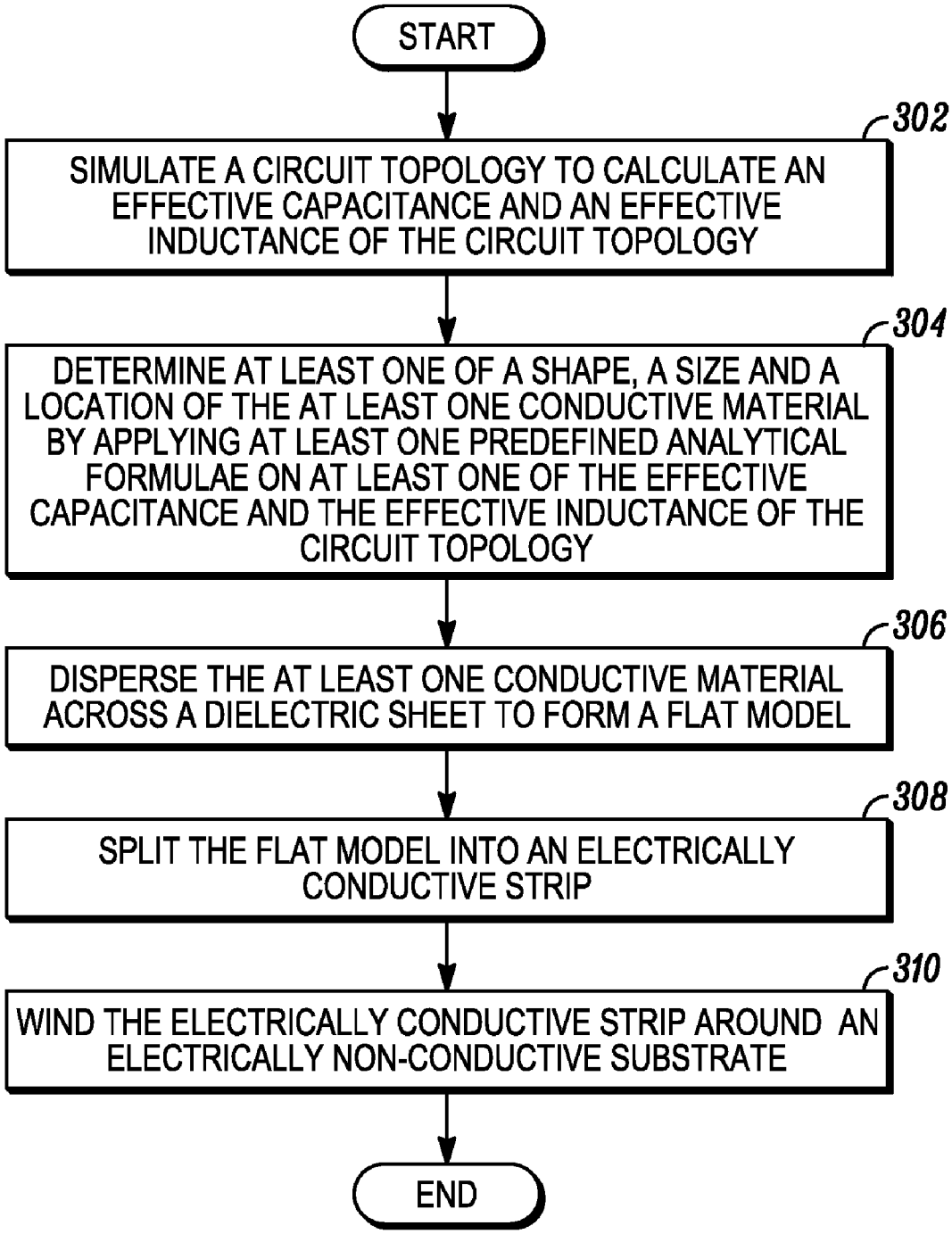
FIG. 3 is a flow chart of a method of forming an antenna, in accordance with another embodiment of the invention.

FIG. 3 is a flow chart of a method of forming the antenna 100, in accordance with another embodiment of the invention. At step 302, a circuit topology of the antenna 100 is simulated based on a predefined frequency range and a predefined frequency response to calculate an effective capacitance and an effective inductance of the circuit topology. The circuit topology may include one or more inductors (L) and one or more capacitors (C). One or more inductors and one or more capacitors may be connected in one or more of a series connection and a parallel connection.

The predefined frequency range and the predefined frequency response are used as design parameters for the antenna 100. Iterative simulations may be performed to achieve the predefined frequency range and the predefined frequency response. After, achieving the predefined frequency range and the predefined frequency response, an effective capacitance and an effective inductance of one or more capacitors and one or more inductors of the circuit topology are calculated.

Thereafter, to convert the circuit topology to a flat model representation of the antenna 100 from, one or more predefined analytical formulae are applied on one or more of the effective capacitance and the effective inductance of the circuit topology at step 304. This determines the shape, size, and a location of one or more conductive materials on a dielectric sheet of the flat model representation of the antenna 100. One or more predefined analytical formulae may be a function of one or more of, but are not limited to a diameter, a number of turns, and a length of the electrically conductive strip 104. For example, a predefined analytical formula may be given by equation (1):

$$L = \frac{[d^2 n^2]}{[l + 0.45d]} \tag{1}$$

where,

L is the inductance d is the distance between overlapping surfaces at the overlap n is the number of turns of the electrically conductive strip 104 l is the length of the electrically conductive strip 104

By way of another example, a predefined analytical formula may be given by equation (2)

$$C = \frac{\varepsilon_o S}{d} \tag{2}$$

where,

C is the capacitance $\in_0$ is the permittivity of free space d is the distance between overlapping surfaces at the overlap S is the surface area of overlapping surface at the overlap Based on one or more of the shape, the size, and the location, one or more conductive materials are dispersed across the dielectric sheet at step 306 to form the flat model representation of the antenna 100. This generates the flat model representation of the antenna 100. One or more conductive materials dispersed on the dielectric sheet determines the radiation response of the antenna 100, details of which are further explained in detail in conjunction with FIG. 4 and FIG. 5.

Thereafter, to translate the flat model representation of the antenna 100 into the antenna 100, the flat model representation is divided into the electrically conductive strip 104 at step 308. The flat model representation may be divided, such that the width of the electrically conductive strip 104 may vary so as to achieve the predefined frequency range and the predefined frequency response. At step 310, the electrically conductive strip 104 is wound around the electrically non-conductive substrate 102 so as to form an overlap between adjacent turns of the electrically conductive strip 104. There is no galvanic connection at the overlap. The overlap between adjacent turns of the electrically conductive strip 104 is less than a width of the electrically conductive strip 104. Additionally, the overlap between adjacent turns may be varied along the length of the electrically non-conductive substrate 102 to achieve the predefined frequency range and the predefined frequency response. This has been explained in detail in conjunction with FIG. 1 given above.

The method of forming the antenna 100 provides a customized flat model representation that achieves a desired frequency response and a desired frequency range. By converting a simulated circuit topology into a flat model representation a desired radiation response can now be achieved. The flat model representation can be further modified to control parameters like, overlap between the adjacent turns, width of the electrically conductive strip 104, and number of turns. The manufacturing process of the antenna 100 is far more flexible when compared to the existing processes for manufacturing antennas. Moreover, the antenna 100 provides enhanced performance as the desired frequency range and the desired frequency response can be accurately controlled and tweaked.

Figure 4A:
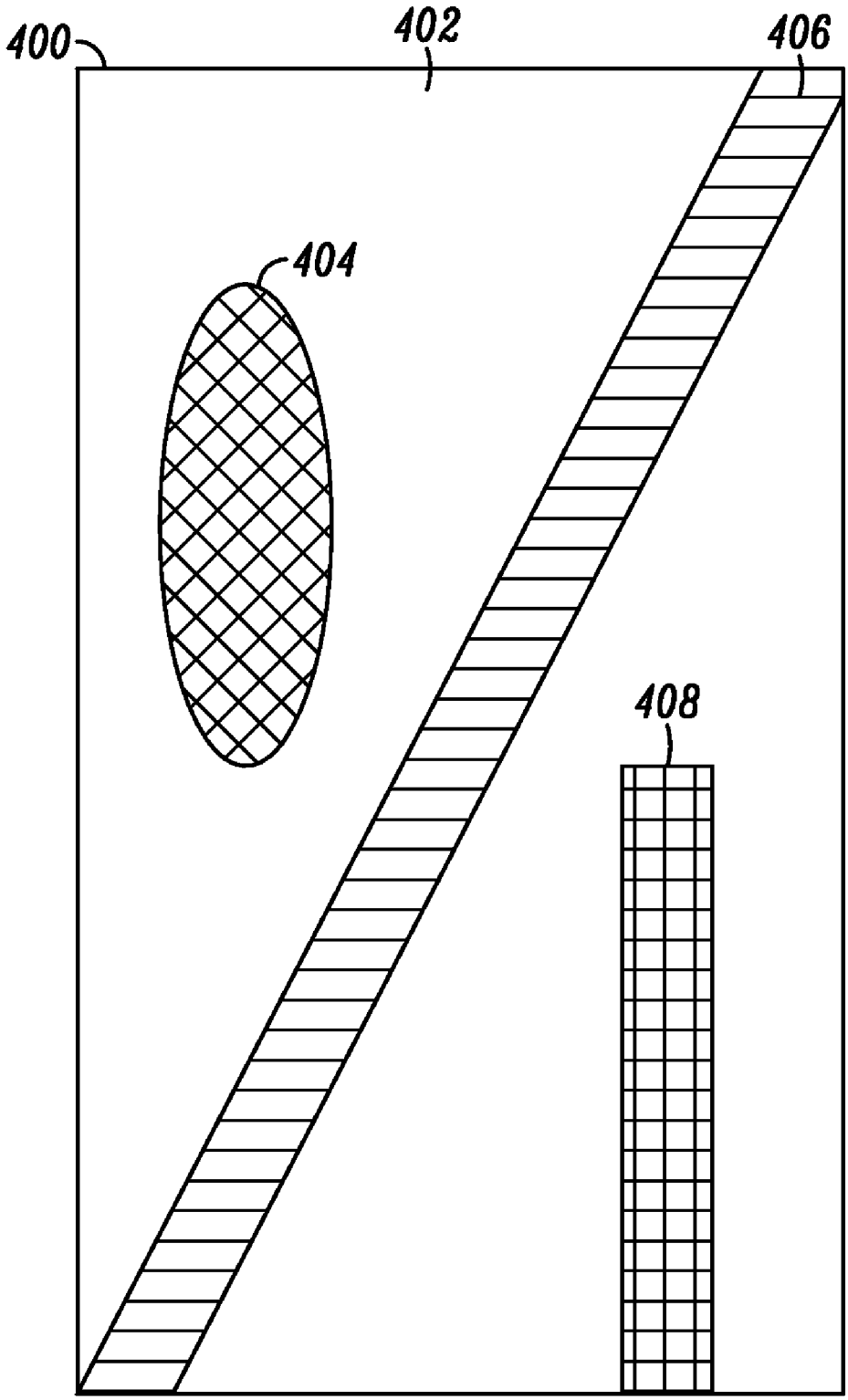
FIGS. 4A and 4B show a flat model representation of an antenna and electrically conductive strips made by dividing the flat model representation, in accordance with an exemplary embodiment of the invention.

FIG. 4A shows a flat model representation 400 of the antenna 100, in accordance with an exemplary embodiment of the invention. As described in FIG. 3, the circuit topology of the antenna 100 is simulated based on the predefined frequency range and the predefined frequency response to calculate the effective capacitance and the effective inductance. The simulation may be performed using a computer based simulation technique.

Thereafter, the circuit topology is converted into the flat model representation 400 of the antenna 100. The flat model representation 400 includes a dielectric sheet 402 and one or more conductive materials dispersed over the dielectric sheet 402. A shape, a size, and a location of one or more conductive materials is determined by applying one or more predefined analytical formulae on one or more of the effective capacitance and the effective inductance of the circuit topology. This has been explained in detail in conjunction with FIG. 3 given above. In this exemplary embodiment, by applying a predefined analytical formula, a shape, a size, and a location of a conductive material is determined as a pattern 404. Thereafter, the conductive material is dispersed on the pattern 404. Similarly, one or more conductive materials are dispersed on a pattern 406 and a pattern 408. It will be apparent to a person skilled in the art that the size, the shape, and the location determined for dispersing one or more conductive material may change for a given frequency range and a frequency response of the antenna 100. The pattern 404, the pattern 406, and the pattern 408 correspond to the radiation response of an antenna made by using the flat model representation 400.

In one scenario, one or more conductive materials dispersed on the pattern 404, the pattern 406, and the pattern 408 may be the same. Alternatively, one or more conductive materials dispersed on the pattern 404, the pattern 406, and the pattern 408 may be different.

To translate the flat model representation 400 to the antenna 100, the flat model representation 400 is divided into the electrically conductive strip 104. Thereafter, the electrically conductive strip 104 is wound around the electrically non-conductive substrate 102. This is further explained in conjunction with FIG. 4B.

Figure 4B:
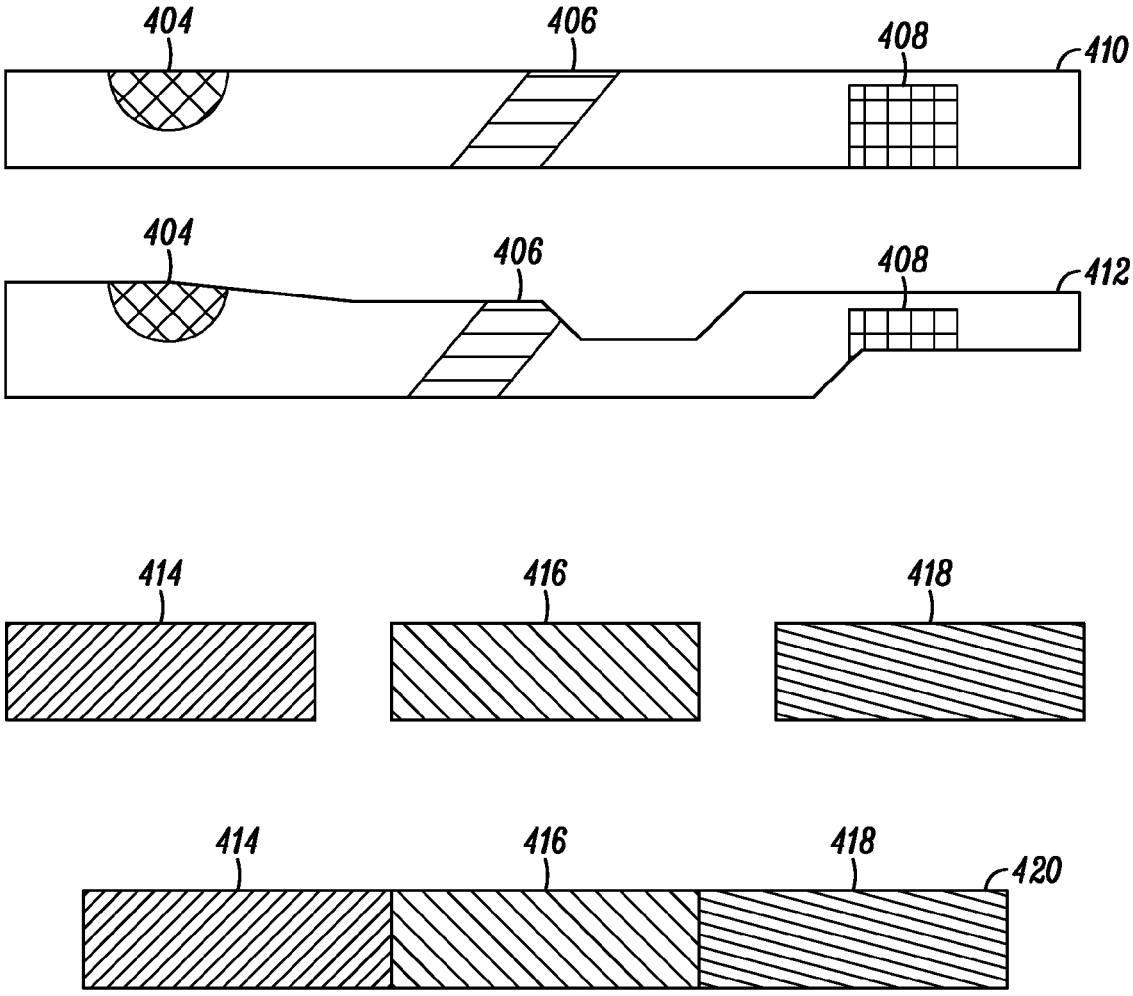

FIG. 4B shows electrically conductive strips made by dividing the flat model representation 400, in accordance with an exemplary embodiment of the invention. The flat model representation 400 may be divided such that an electrically conductive strip 410 is obtained. The electrically conductive strip 410 has a uniform width along its length. Therefore, the electrically conductive strip 410 may have the pattern 404, the pattern 406 and the pattern 408 spread across the electrically conductive strip 410. Alternatively, the flat model representation 400 may be divided such that, an electrically conductive strip 412 that has a varying width along its length is generated. This variation in width changes a frequency response and a frequency range provided by an antenna.

Each of the electrically conductive strip 408 and electrically conductive strip 410 may be generated in a single piece from the flat model representation 400. For example, the flat model representation 400 may be cut in a continuous fashion, such that there is no break in the electrically conductive strip 408. Alternatively, the flat model representation 400 may be divided into a plurality of electrically conductive strips (for example, an electrically conductive strip 414, an electrically conductive strip 416, and an electrically conductive strip 418). Thereafter, the plurality of electrically conductive strips may be connected in series to form an electrically conductive strip 420. Each of the electrically conductive strip 414, the electrically conductive strip 416, and the electrically conductive strip 418 may be of the same material. Alternatively, each of the electrically conductive strip 414, the electrically conductive strip 416, and the electrically conductive strip 418 may be of different materials. For example, the electrically conductive strip 414 may be a copper strip, the electrically conductive strip 416 may be a brass strip, and the electrically conductive strip 418 may be an aluminum strip.

Figure 5:
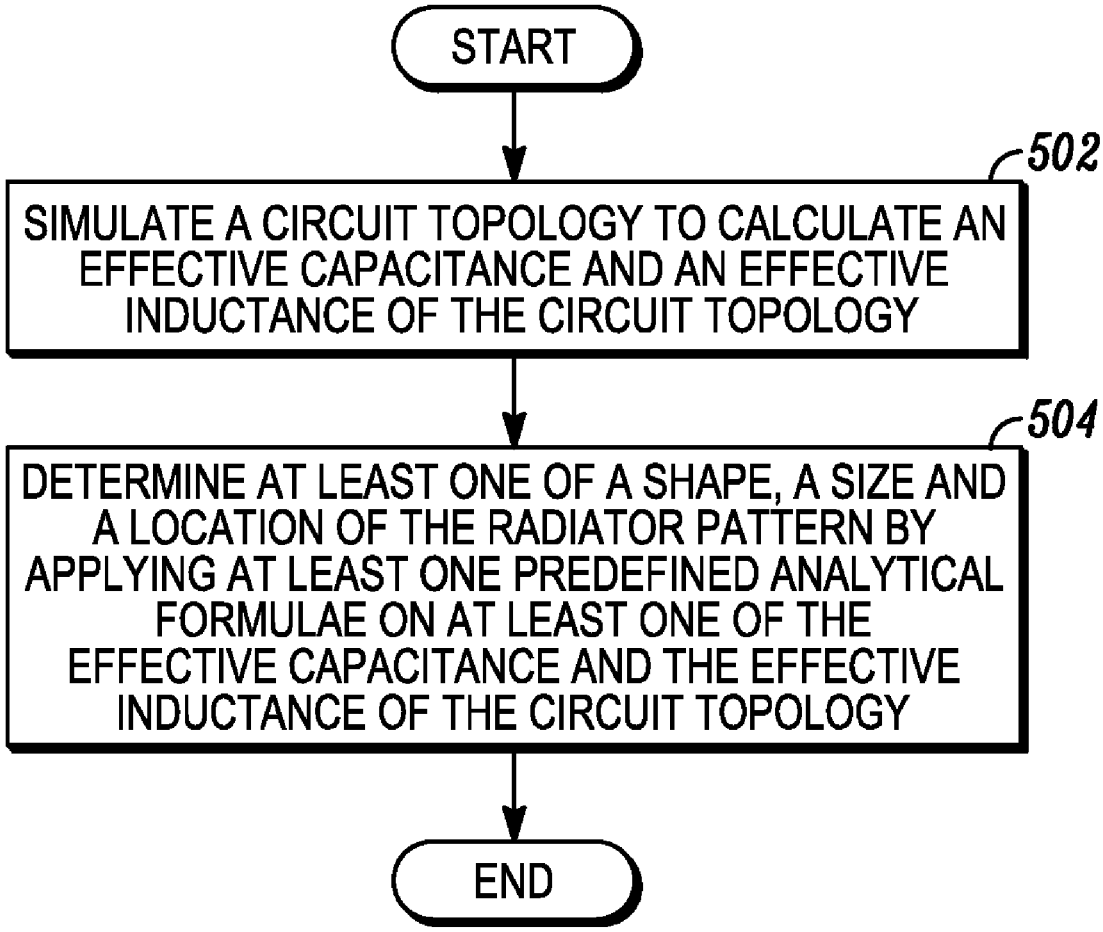
FIG. 5 is a flow chart of a method for representing a radiation response of an antenna, in accordance with an embodiment of the invention.

FIG. 5 is a flow chart of a method for representing a radiation response of the antenna 100, in accordance with an embodiment of the invention. At step 502, a circuit topology corresponding to the antenna 100 is simulated based on a predefined frequency range and a predefined frequency response to calculate an effective capacitance and an effective inductance of the circuit topology. The circuit topology may include one or more inductors (L) and one or more capacitors (C). The predefined frequency range and the predefined frequency response may be design parameters corresponding to the antenna 100. This process is repeated iteratively to achieve the predefined frequency range and the predefined frequency response. This has been explained in detail in conjunction with FIG. 3 given above.

At step 504, one or more predefined analytical formulae are applied on one or more of the effective capacitance and the effective inductance of the circuit topology to determine one or more of a shape, a size, and a location of the radiation the antenna 100. Thereafter, one or more conductive materials are dispersed according to one or more of the shape, the size and the location determined for the radiation response. For example, one or more conductive materials are dispersed on pattern 404, pattern 406, and pattern 408 on the dielectric sheet 402.

Various embodiments of the invention provide an antenna and methods of forming the same. A predefined frequency range and a predefined frequency response of the antenna formed in accordance with the embodiment of the invention depends on parameters, such as, overlap between the adjacent turns, width of an electrically conductive strip, the number of turns of the electrically conductive strip, the distance between overlapping surfaces in adjacent turns, and the dielectric between the overlapping surfaces. These parameters can be easily controlled and tweaked, to accurately achieve a desired frequency range and a desired frequency response. This further facilitates the antenna to support wideband and multiband coverage Additionally, in accordance with an embodiment of the invention, the desired frequency response and the desired frequency range are achieved by using a customized flat model representation. The customized flat representation is generated from a simulated circuit topology, which can be easily modified to represent the desired frequency response and the desired frequency range without involving any mechanical modifications. Therefore, the manufacturing process of the antenna 100 is far more flexible when compared to the existing processes for manufacturing antennas.

Those skilled in the art will appreciate that the above recognized advantages and other advantages described herein are merely exemplary and are not meant to be a complete rendering of all of the advantages of the various embodiments of the present invention.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The present invention is defined solely by the appended claims including any amendments made during the pendency of this application and all equivalents of those claims as issued.

What is claimed is:

1. An antenna comprising:

an electrically non-conductive substrate rod; and an electrically conductive strip, wherein the electrically conductive strip is formed as a single piece wound around the electrically non-conductive substrate rod so as to form an overlap between adjacent turns of the electrically conductive strip, wherein a galvanic connection at the overlap is absent; and a dielectric material filled within the overlap between adjacent turns of the electrically conductive strip.

2. The antenna of claim 1, wherein the overlap between adjacent turns of the electrically conductive strip is less than a width of the electrically conductive strip.

3. The antenna of claim 1, wherein the overlap between adjacent turns of the electrically conductive strip varies along a length of the electrically non-conductive substrate.

4. The antenna of claim 2, wherein the width of the electrically conductive strip varies along a length of the electrically non-conductive substrate.

5. The antenna of claim 1, wherein the electrically conductive strip is one of a copper strip, a brass strip, an aluminum strip, and a stainless steel strip.

6. The antenna of claim 1, wherein the electrically non-conductive substrate is one of a rubber rod, a plastic rod, a polycarbonate rod and an elastomer rod.

7. The antenna of claim 1, wherein the electrically non-conductive substrate comprises a plurality of heterogeneous substrates.

8. The antenna of claim 1, wherein the electrically non-conductive substrate is cylindrical in shape.

9. The antenna of claim 1, wherein the electrically conductive strip comprises a plurality of strips connected in series.

10. The antenna of claim 1, wherein a plurality of electrically conductive strips are wound over the electrically non-conductive substrate.

11. The antenna of claim 3, wherein a frequency range of the antenna increases corresponding to a decrease in the overlap between adjacent turns of the electrically conductive strip.

12. The antenna of claim 3, wherein a frequency response of the antenna increases corresponding to at least one of an increase in number of turns of the electrically conductive strip around the electrically non-conductive substrate and a decrease in the overlap between adjacent turns of the electrically conductive strip.

13. The antenna of claim 1, wherein an increase in the number of turns of the electrically conductive strip around the electrically non-conductive substrate corresponds to an increase in the number of resonant elements, wherein a resonant element comprises an inductor and a capacitor.

14. The antenna of claim 1, wherein a frequency range of the antenna increases corresponding to a decrease in distance between overlapping turns of the antenna.

15. The antenna of claim 1, further comprising a dielectric material filled within the overlap between adjacent turns of the electrically conductive strip.

16. The antenna of claim 1, wherein the overlap between adjacent turns of the electrically conductive strip provides a resonant element.

17. A method for forming an antenna, the method comprising:

converting a circuit topology of the antenna into a flat model representation of the antenna, wherein the flat model representation comprises at least one conductive material dispersed across a dielectric sheet;

translating the flat model representation to provide a predefined frequency range and a predefined frequency response for the antenna;

dividing the flat model representation into an electrically conductive strip, the electrically conductive strip being a single piece; and winding the electrically conductive strip around a rod-shaped, electrically non-conductive substrate, wherein overlapping surfaces are formed between adjacent turns of the electrically conductive strip; and introducing a dielectric material between overlapping surfaces between adjacent turns.

18. The method of claim 17 further comprising simulating the circuit topology to calculate an effective capacitance and an effective inductance of the circuit topology based on the predefined frequency range and the predefined frequency response, the circuit topology comprising at least one capacitor and at least one inductor.

19. The method of claim 18, wherein converting comprises determining at least one of a shape, a size, and a location of the at least one conductive material on the dielectric sheet by applying at least one predefined analytical formula on at least one of the effective capacitance and the effective inductance of the circuit topology.

20. The method of claim 19, wherein the at least one predefined analytical formula is a function of at least one of a diameter, a number of turns, and a length of an electrically conductive strip.

21. The method of claim 17, wherein translating comprises winding an electrically conductive strip of the flat model representation around an electrically non-conductive substrate, wherein an overlap is formed between adjacent turns of the electrically conductive strip.

22. The method of claim 21 further comprising dividing the flat model representation into the electrically conductive strip.

23. The method of claim 21, wherein the overlap between adjacent turns of the electrically conductive strip is less than a width of the electrically conductive strip.

24. The method of claim 21, wherein the overlap between adjacent turns of the electrically conductive strip varies along a length of the electrically non-conductive substrate.

25. The method of claim 21, wherein the width of the electrically conductive strip varies along a length of the electrically non-conductive substrate.

26. A method for forming an antenna, the method comprising:

providing a non-conductive substrate rod; and winding an electrically conductive strip around the non-conductive rod so as to form an overlap between adjacent turns of the electrically conductive strip, the electrically conductive strip being formed based on a flat model representation of the antenna, the flat model representation of the antenna being formed by:

simulating a circuit topology to calculate an effective capacitance and an effective inductance of the circuit topology based on a predefined frequency range and a predefined frequency response, wherein the circuit topology comprises at least one capacitor and at least one inductor;

determining at least one of a shape, a size, and a location of one or more conductive materials by applying at least one predefined analytical formulae on at least one of the effective capacitance and the effective inductance of the circuit topology;

dispersing the one or more conductive materials across a dielectric sheet to form the flat model representation of the antenna; and dividing the flat model representation into the electrically conductive strip.

27. The method of claim 26 further comprising dispersing at least one conductive material across a dielectric sheet in accordance with at least one of the shape, the size, and the location determined for the radiation response.

* * * * *

UNITED STATES PATENT AND TRADEMARK OFFICE

CERTIFICATE OF CORRECTION

PATENT NO. : 8,248,323 B2
APPLICATION NO. : 12/129739
DATED : August 21, 2012
INVENTOR(S) : Grossman et al.

It is certified that error appears in the above-identified patent and that said Letters Patent is hereby corrected as shown below:

On the Title Page, in Item (75), under "Inventors", in Column 1, Line 3, delete "Natanya" and insert -- Netanya --, therefor.

In the Specification:

In Column 1, Lines 33-34, delete "frequencies" and insert -- frequencies. --, therefor.

In Column 4, Line 49, delete "(not shown" and insert -- 130 (shown --, therefor.

In Column 4, Line 50, delete "FIG. 1B)" and insert -- FIG. 1C) --, therefor.

In Column 5, Line 55, delete "overlap" and insert -- overlap. --, therefor.

In Column 8, Line 6, delete "coverage" and insert -- coverage. --, therefor.

Signed and Sealed this
Tenth Day of September, 2013

Teresa Stanek Rea
*Acting Director of the United States Patent and Trademark Office*